US005641368A

United States Patent [19]

Romes et al.

[11] Patent Number: 5,641,368

[45] Date of Patent: Jun. 24, 1997

[54] FIBERGLASS SPRAY INSULATION SYSTEM AND METHOD WITH REDUCED DENSITY

[75] Inventors: Gary E. Romes, Cincinnati, Ohio; Mark H. Vagedes, Warrenville, Ill.; Joseph T. Church, Memphis, Tenn.

[73] Assignee: Guardian Fiberglass, Inc., Albion, Mich.

[21] Appl. No.: 572,626

[22] Filed: Dec. 14, 1995

[51] Int. Cl.[6] ..... E04B 2/00; E04B 1/74

[52] U.S. Cl. ..... 156/71; 156/293; 156/326; 52/742.13; 239/9

[58] Field of Search ..... 156/71, 293, 326; 52/742.13, 742.14, 742.15; 239/9; 264/121

[56] References Cited

U.S. PATENT DOCUMENTS

| | | |
|---|---|---|
| 1,888,841 | 11/1932 | Wenzel et al. . |
| 2,989,790 | 6/1961 | Brown . |
| 3,619,437 | 11/1971 | McDonald, Jr. . |
| 4,177,618 | 12/1979 | Felter . |
| 4,468,336 | 8/1984 | Smith . |
| 4,487,365 | 12/1984 | Sperber . |
| 4,673,594 | 6/1987 | Smith . |
| 4,710,309 | 12/1987 | Miller . |
| 4,712,347 | 12/1987 | Sperber . |
| 4,768,710 | 9/1988 | Sperber . |
| 4,773,960 | 9/1988 | Vincelli et al. . |
| 4,804,695 | 2/1989 | Horton . |
| 4,822,679 | 4/1989 | Cerdan-Diaz et al. . |
| 5,085,897 | 2/1992 | Luckanuck . |
| 5,131,590 | 7/1992 | Sperber . |
| 5,155,964 | 10/1992 | Fortin et al. . |
| 5,287,674 | 2/1994 | Sperber . |
| 5,389,167 | 2/1995 | Sperber . |
| 5,393,794 | 2/1995 | Sperber . |
| 5,421,922 | 6/1995 | Sperber . |

OTHER PUBLICATIONS

Certaspray® Fiberglass Spray Insulation Manual/Brochure, 1982, Including Job Report and pp. 1–39.

Certaspray® Fiber Glass Spray Insulation Specification Sheet, 1982.

ASFI American Sprayed Fibers, Inc., Fireproofing and Acoustical Products.

Cafco Sound–Shield Application and Installation Manual.

Cafco Blaze–Shield and Blaze–Shield II Application and Installation Manual.

Sun–System and Sun–Guard II Sprayed Insulation by Suncoast Insulation Mfg. Co.

Perfect Fit™ Fiberglass Insulation.

The New Generation of Wall Insulation R–Pro Plus Wall System.

Suncoast Insulation, S.A.B. System™ Light Density Cafco 400 Sprayed Fire Protection.

"Spray–on Energy Seal," Energy/Wise/Engery Seal, 1990.

*Primary Examiner*—Michael W. Ball
*Assistant Examiner*—Sam Chuan Yao
*Attorney, Agent, or Firm*—Myers Liniak & Berenato

[57] ABSTRACT

A spray-on inorganic (e.g. fiberglass) insulation method and product with a low density and high R-value are disclosed. Loose-fill fiberglass is coated with a non-foaming liquid and thereafter blown or sprayed into a cavity such as a vertically extending open stud-defined wall cavity. After sticking in the cavity, the insulation is rolled to further pack it into the cavity and thereafter allowed to cure.

11 Claims, 1 Drawing Sheet

FIBERGLASS SPRAY INSULATION SYSTEM AND METHOD WITH REDUCED DENSITY

FIELD OF THE INVENTION

This invention relates to a system and method for spraying or blowing insulation into an open cavity. More particularly, this invention relates to a system and method for spraying loose-fill inorganic fiber insulation (e.g. fiberglass) coated with an adhesive into an open cavity, such as between wall studs, with the resulting cured insulation product having reduced density, a high R-value and a relatively low LOI (loss-on-ignition).

BACKGROUND OF THE INVENTION

Fiberglass batt installation typically requires the time consuming cutting up or shaping of batts when the need arises to fill abnormally or irregularly shaped open cavities between studs, or insulate around electric boxes, wires, and the like. Furthermore, structures insulated with batts often suffer from less than desirable thermal and sound insulation due to the void areas sometimes found around the edges of the batts adjacent studs or other supporting structure.

In recent years, a number of loose-fill insulation systems have been developed in an attempt to overcome these disadvantages inherent in commercial fiberglass batt usage. In order to install density loose-fill fiberglass insulation in enclosed vertically extending residential wall (stud bounded) cavities in a practical manner and at a commercially acceptable cost, it has heretofore been known to resort to the BIBS (Blown-In-Blanket™) system disclosed, for example, in U.S. Pat. Nos. 4,712,347 and 5,287,674 to Sperber. Many residential contractors and the like use the BIBS system instead of fiberglass batts for the purpose of improving insulative qualities (both thermal and sound) and application efficiency.

In accordance with BIBS, a flexible netting (e.g. nylon) or the like is affixed across a plurality of wall studs in order to enclose vertically extending cavities. Thereafter, hole(s) are formed in the netting and a blowing hose is inserted into the hole(s) for the purpose of filling the enclosed wall cavities with blown loose-fill silicone coated fiberglass insulation. Instead of silicone, other hydrophobic agents which are moisture repellant may be used to coat the fiberglass. An exemplary insulation which may be used in conjunction with BIBS is InsulSafe III™ available from CertainTeed Corp. This loose-fill fiberglass when used with BIBS is able to achieve an R-15 at a density of 2.5 lbs./ft$^3$ when 3.5 inches thick.

The drawbacks or disadvantage of BIBs is its time consuming nature with respect to transporting and erecting the netting. Installing such netting generally takes as long or longer than filling the cavities. Additionally, settling may occur after blowing is complete in certain BIBS applications. Accordingly, it will be clear to those of skill in the art that a need exists for eliminating the enclosing structure (e.g. netting) of the BIBS system.

Spray-on systems for open cavities are alternatives to both fiberglass batts and BIBS™ which allow the user to avoid the installation and use of netting and the like. As will be appreciated by those of skill in the art, prior art spray-on insulation systems/products are properly divided into two separate categories: (i) organic spray-on products (e.g. cellulose); and (ii) inorganic fiber-based spray-on products such as fiberglass.

A. ORGANIC (CELLULOSE) SPRAY-ON PRODUCTS

One known organic spray-on insulation product is sold by Suncoast Co. and known commercially as SUN-GUARD II™. As set forth in the SUN-GUARD II™ brochure, this cellulose insulation product requires a density of 2.9 lbs./ft$^3$ to achieve an R-value (thermal resistance) of eleven (11) at an insulation thickness of about three (3) inches (R-value= about 3.67 per inch). This is an undesirably high density for commercial residential applications for reasons to be discussed below.

A further problem with SUN-GUARD II™ is that it utilizes cellulose (instead of an inorganic fiber product) as the insulating material. Cellulose is an organic material including wood fibers which originate from wood products such as newspaper, kraft paper, cardboard, etc. Cellulose and its organic nature are generally undesirable in many applications for the following reasons: (i) its organic nature renders it attractive to mold, mildew, fungus, rodents, vermin, etc.; (ii) cellulose absorbs moisture (moisture does not simply coat the product as with fiberglass) rendering it susceptible to rot, decay, and requiring undesirably long cure times when exposed to liquid spray additives (especially in humid environments); (iii) cellulose often settles to a greater degree than, for example, fiberglass, thereby decreasing R-values within a filled cavity as time passes; (iv) cellulose is less aesthetically appealing to many users than, for example, fiberglass; and (v) an added chemical load is required to be added to cellulose for flame resistance purposes (fiberglass in of itself is flame resistant)—this, of course, increasing the cost of the product and sometimes creating an unfriendly odor.

U.S. Pat. No. 4,773,960, assigned to Suncoast Insulation Manufacturing, Inc. discloses a cellulose loose-fill insulation application system (see also Suncoast's S.A.B.™ System). Dry adhesive and cellulose-based insulation are sprayed or blown together with water which activates the adhesive during blowing. Drawbacks or disadvantages of this system include both its organic nature and its non-applicability to insulating vertically extending open cavities such as those defined between residential wall studs. The system of the '960 patent only "enables loose-fill insulation to be applied on surfaces that are inclined as steeply as forty-five degrees" (i.e. not on vertically extending surfaces such as residential walls defining open stud-bound cavities). Furthermore, because water actually penetrates cellulose during spraying (i.e. it becomes saturated), long curing times are required as are large quantities of adhesive. The more adhesive used, the less cost efficient the product and the more burdensome the clean up.

After spray-on cellulose products such as these have been blown into the open cavity, a powered scrubber or scrubbing device is typically used to remove (i.e. scrape off) the excess insulation from the cavity area exterior the studs so that wall board or the like may be affixed to the studs after curing. Such powered scrubbers will not, however, work on fiberglass loose-fill because the powered reverse rotating action often used would tend to tear large chunks of the fiberglass from the cavity.

Another attempt at developing and commercially implementing a spray-on organic-based insulation system(s) was made by American Sprayed Fibers, Inc. (ASFI) in the 1980s by way of a fireproofing system called DENDAMIX™ and a sound insulating product called SOUND-PRUF™. See also U.S. Pat. No. 4,710,309. As set forth in the prior art ASFI brochure and test results listed therein, these ASFI products are a blend of rock wool and cellulose sprayed together with an adhesive for sticking on walls (e.g. within stud-defined vertically extending open cavities). Unfortunately, the ASFI spray-on products suffer from the many problems discussed above with regard to cellulose and still more.

Turning to the ASFI spray-on DENDAMIX™ product, the test results provided in the ASFI brochure indicate that in order to achieve an R-value of 3.4 per inch thickness, a five (5) lb./ft$^3$ density was required. This is an undesirably high density requirement which leads to both potential insulation fall-out and increased cost. DENDAMIX™ also requires an undesirably large quantity of adhesive (55 gallons for 300 lbs. of insulation) which creates both the increased density and an undesirably high LOI (loss on ignition, which is indicative of the adhesive amount used). As low an LOI as possible is generally desired in that the greater the adhesive percentage of the final insulating product, the higher the cost of the product.

With respect to ASFI's SOUND-PRUF™ system and product, again, an undesirably large or high density of 5 lb./ft$^3$ is required to achieve an R-value of 3.4 per inch thickness, which is similar to the DENDAMIX™ values discussed above.

U.S. Pat. No. 4,804,695 discloses another organic cellulose spray-on insulation product and system which achieves a density less than the above-described Suncoast products (e.g. 2.0 lb./ft$^3$ with an R-value of 3.7 per inch thickness). Unfortunately, the organic (cellulose) nature of the product/system of the '695 patent is undesirable as compared to inorganic fiber-based insulation systems such as fiberglass for the multiplicity of reasons set forth above.

R-Pro™ and R-Pro Plus™ are other commercially available cellulose blow or spray products similar in many ways to the '695 product which suffer from many of the same problems due to their organic/cellulose nature.

B. PRIOR ART FIBERGLASS SPRAY-ON PRODUCTS

The use of spray-on fiberglass (which is inorganic), instead of cellulose, solves many of the problems set forth above which are inherent in spray-on organic (e.g. cellulose) insulations. Unfortunately, known spray-on fiberglass products have problems of their own.

One prior art attempt at using an inorganic spraying or blowing system to loose-fill fiberglass insulate open cavities was made by CertainTeed by way of a product/system known as CertaSpray™. Fiberglass is the insulation material long preferred by architects, builders, and insulation contractors because it is non-moisture-absorbing and provides consistently uniform R-values. As set forth in the CertaSpray™ brochure, for example, "since there's no fiber wetting and saturation, as with cellulose spray insulation, CertaSpray™ requires less adhesive" and thus a lower LOI. The fact that fiberglass fibers are merely coated rather than saturated during blowing also reduces the time required for curing.

While CertaSpray™ is a fiberglass based system which is advantageous in of itself over cellulose, the CertaSpray™ system suffers from a number of significant drawbacks discussed below which resulted in the product/system not being readily useable residential (as opposed to commercial) applications. Firstly, and perhaps most importantly, the cured and installed insulation product when three (3) inches thick required a density of at least 3.5 lbs. per cubic foot (lbs./ft$^3$) to obtain an R-value of twelve (12). This density requirement was much too heavy for successful residential application because (i) the higher the density, the higher the cost to manufacture and install the product due to the higher amount of fiber used; (ii) the higher the density, the longer the cure time, and (iii) the higher the density of spray-on insulation, on a vertical wall, for example, the higher the probability of insulation fall-out (i.e. the sprayed-on loose-fill becoming detached from the wall and falling to the ground). Furthermore, as recognized by CertaSpray™, "less fiber fly means a cleaner and faster job, both during application and clean up." Accordingly, much of the residential insulating market has found it cheaper and more efficient to use fiberglass batts or BIBS instead of the spray-on CertaSpray™ product.

Another significant drawback associated with the CertaSpray™ system is that the applied insulation generally takes an average of about eight (8) days to dry when applied to a three (3) inch thickness as set forth in the CertaSpray™ manual due to the large amount of liquid binder used. For example, when a loose-fill bag is blown in four minutes about 1.125 gallons of liquid is sprayed per minute, thus resulting in an undesirably high applied LOI and moisture % upon application. In fact, as indicated in the CertaSpray™ manual, it is Applicants' belief that the weight of the liquid sprayed outweighs the weight of fiberglass blown per time unit (i.e. the liquid sprayed weighs more than the loose-fill as measured upon application). As can be imagined, the resulting cure time is too long for residential acceptance where drywall is typically applied within a day or two after insulation installation.

Other inorganic spray-on products such as CAFCO™ are commercially known as fire protection or fireproofing materials used in commercial settings such as for I-beams, roof constructions, columns, etc. Unfortunately, inorganic products such as these also have undesirably high densities (e.g. CAFCO™ 400 has a tested density of 25 lb./ft$^3$).

It has also been found by the instant inventors that fiberglass spray-on products which utilize fiberglass coated with silicone require too much adhesive and/or density to be commercially practical in residential settings in view of the fact that the silicone typically used to coat loose-fill fiberglass inhibits spray-on adhesion or fiber bonding.

In view of the above, it is apparent that there exists a need in the art for a spray-on inorganic insulation (e.g. fiberglass) system which (i) eliminates the need for the netting of the BIBS system, (ii) is capable of spraying/blowing quick-setting (i.e. fast curing) inorganic coated insulation such as fiberglass into a vertically extending cavity so that the sprayed loose-fill "sticks" in the cavity so as to provide a high R-value together with a low density or weight and low LOI without suffering from the disadvantages of cellulose; and (iii) is substantially free of silicone.

SUMMARY OF THE INVENTION

It is an object of this invention to provide a spray-on fiberglass system and method having a moisture percentage (measured immediately after spraying) less than about 35%, a density less than about 2.5 lb.ft$^3$, and an applied LOI less than about 2%.

Generally speaking, this invention fulfills the above-described needs in the art by providing a method of spraying loose-fill fiberglass insulation together with a non-foaming liquid into a vertically extending open cavity for the purpose of filling the open cavity with insulation, the method comprising the steps of:

- coating the loose-fill fiberglass with the non-foaming liquid;
- blowing the loose-fill fiberglass insulation coated with the non-foaming liquid into the vertically extending open cavity so that the coated fiberglass insulation is retained in the cavity thereby insulating same; and
- allowing the coated fiberglass insulation in the open cavity to cure or dry so that when the installed and cured fiberglass insulation is about 3.5 inches thick, it has an R-value of at least about 11.0 and a density of less than or equal to about 2.5 lb.ft$^3$.

According to certain preferred embodiments of this invention, the insulation has an applied LOI less than about 10%, preferably less than about 5%, and most preferably less than about 2%.

Still further, this invention fulfills the above-described needs in the art by providing a vertically extending fiberglass insulated open cavity comprising:

a pair of vertically extending studs;

a vertically extending wall surface affixed to the studs so as to define the open cavity between the studs; and a sprayed-on fiberglass insulation substantially filling and sticking by itself within the open cavity, the sprayed on fiberglass having an R-value of at least about 3.15 per inch thickness and an applied LOI less than or equal to about 2.0%.

This invention will now be described with respect to certain embodiments thereof, accompanied by certain illustrations wherein:

IN THE DRAWINGS

DETAILED DESCRIPTION OF CERTAIN EMBODIMENTS OF THIS INVENTION

Figure 1:
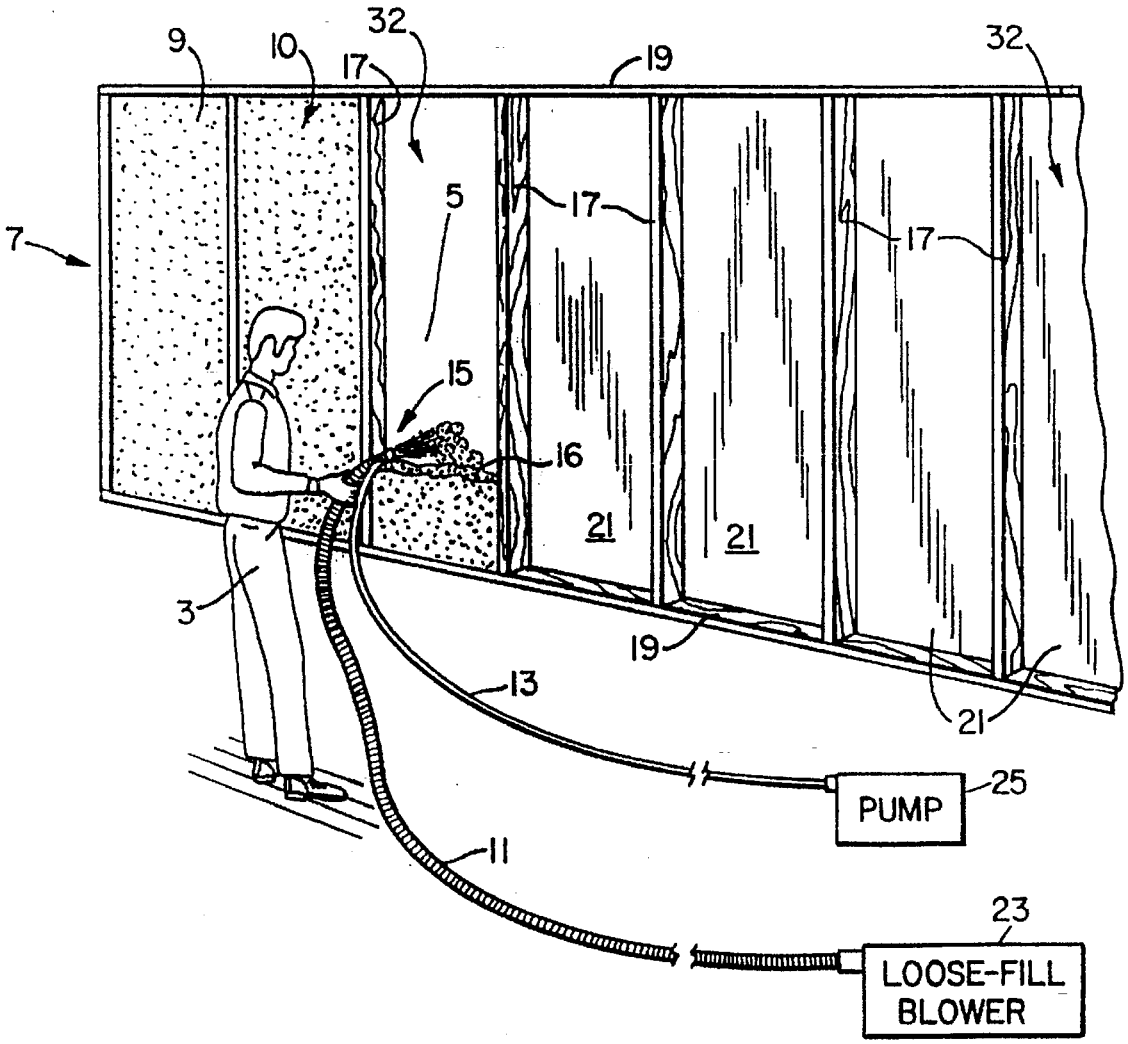
FIG. 1 is a perspective view of a user spraying or blowing liquid coated loose-fill fiber-based inorganic insulation into a vertically extending open cavity in accordance with this invention.

FIG. 1 is a perspective view illustrating user 3 spraying or blowing loose-fill fiber-based (e.g. fiberglass) insulation coated with a liquid into vertically extending open cavity 5 so as to achieve a low density insulation having satisfactorily high R-values and a low LOI. The purpose of this invention is to achieve as low a density as possible together with a high R-value and a low moisture %, and to use as little adhesive as possible so as to keep costs down.

As shown, user 3 is provided with loose-fill blow hose or tube 11 and liquid supply hose 13. At nozzle area 15, the loose-fill inorganic fiber insulation blown from hose 11 is coated with the liquid (e.g. water or liquid adhesive) from hose 13 and thereafter sprayed into open cavity 5. Alternatively, hoses 11 and 13 may be combined at an earlier stage (not shown) so that user 3 is provided with only one hose nozzle to grip, in which case the fiber is coated earlier with the liquid at the hose junction.

While user 3 is shown standing on the ground in FIG. 1, according to an alternative embodiment, the user is provided with conventional stilts so that user 3 can continually spray the insulation downward at an angle (or level) onto shelf 16 being formed in cavity 5. In such a manner, the sprayed insulation more easily sticks or bonds within cavity 5 as shelf 16 is used to build the sprayed insulation upon itself in order to fill the cavity.

According to certain embodiments of this invention, blow hose 11 supplies virgin loose-fill fiberglass (substantially free of silicone) and hose 13 supplies a liquid based adhesive so that the fiberglass is coated with the liquid adhesive at nozzle area 15. The use of the term "coated" or "coating" means that the liquid does not penetrate substantially the inorganic fiber. According to alternative embodiments of this invention, blow hose 11 supplies white loose-fill fiberglass mixed with a dry adhesive (e.g. redispersible powder) and hose 13 supplies a liquid such as water for activating the adhesive so that the loose-fill/dry adhesive mixture is coated with the liquid at nozzle area 15 thereby activating the adhesive so that the blown coated fiberglass sticks (i.e. is retained) in open cavity 5 into which it is blown. The sprayed insulation in either case adheres to or sticks to vertical wall 32 which may be of plywood, Celotex™, or any other known residential exterior insulating sheeting. No netting or other supporting structure is needed to retain the sprayed-on fiber in cavity 5.

As shown in FIG. 1, each vertically extending open cavity of wall structure 7 is bounded on either side by vertical studs 17 and on the top and bottom by horizontal studs 19. These studs may be 2"×4" each, for example, as is known in the trade. Open cavities 9 and 10 in FIG. 1 have been filled with the loose-fill spray-on insulation while open cavities 21 have not (open cavity 5 is in the process of being filled).

Loose-fill insulation blower 23 is attached to hose 11 and may be, for example, a commercially available model such as one from the Unisul Volumatic Series, or the Meyers Fibreking Series. Blower 23 functions to blow the loose-fill inorganic insulation (e.g. fiberglass) through hose 11 to nozzle area 15 where it is coated with the liquid (e.g. liquid adhesive) from hose 13. Commercially available pump 25 is attached to hose 13 for the purpose of pumping the liquid to nozzle area 15. Pump 25 may be, for example, any known insulation spray adhesive pump capable of attaining and maintaining approximately 0.15 to 1.0 gallons per minute at about 50 to 200 lbs. per square inch (PSI). The liquid (e.g. water) coating the fiber keeps the blown fiber in cavity 5 during spraying, while the adhesive functions to hold the blown fiber in cavity 5 after curing and provides desirable integrity.

Blow hose 11 and adhesive hose 13 may be, for example, from about 50 ft. to 150 ft. long according to certain embodiments of this invention, with hose 11 having a diameter of about 2½ to 3 inches between blower 23 and a point about ten feet from the nozzle area, the diameter being reduced to about 2½ inches at this point up to nozzle area 15. Liquid adhesive hose 13 should have a pressure rating of about twice that of the maximum pressure capacity of pump 25 and may be, for example, a one-quarter inch diameter high pressure hose.

According to certain embodiments, the liquid adhesive provided through hose 13 may be a water-based vinyl acetate homopolymer/polyvinyl alcohol blend with approximately 45% to 50% resin solids used. A polymer cross-linking catalyst is also provided in the water-based adhesive according to certain embodiments of this invention. The polymer cross-linking catalyst may be, for example, ammonium chloride or ammonium dihydrogen phospate at about 25% solution. The adhesive (and catalyst) is commercially available as Resin No. 51-5626 from United Resins, Chicago, Ill., this adhesive having a resin solid content of about 50%.

With regard to the loose-fill insulation provided through hose 11, fiberglass loose-fill substantially free of silicone having a fiber diameter of from about 3.5 to 5 microns (μm) is preferable, this virgin white fiberglass including substantially no binder adhesive (e.g. total LOI of only about 0.20% before being coated at nozzle area 15). The substantial absence of silicone (or other hydrophobic water-resistant agent) has been found to allow the liquid coated loose-fill to bond more easily within cavity 5. Alternatively, plastic or other inorganic fiber insulation may be used instead of fiberglass provided that the fiber insulation used has properties similar to those of fiberglass.

White loose-fill virgin fiberglass (uncoated with silicone or any other hydrophobic agent) having a standard cube size available from Guardian Industries, Albion, Mich., is a preferable loose-fill which may be utilized. Standard yellow or pink loose-fill fiberglass binder inclusive insulation (of the type used in residential batts) is also feasible, but results in a higher total (and sometimes applied) LOI which increases cost.

With respect to the hose tips adjacent nozzle area 15 manipulated by user 3, the spray head is defined by a circular metal chamber having a one-quarter inch supply line with a control valve and quick connect coupling fitted over a machined PVC nozzle inserted into the discharge end of blow hose 11 in order to apply the liquid from hose 13 to the fiber (i.e. coat the fiber) as it exits the discharge end of hose 11 at the spray head. Spray jets, not shown, (e.g. H1/SVV1501 or H1/SVV2501 commercially available from Spraying Systems, Wheaton, Ill.) are threaded into the face of the spray head in order to atomize and direct the adhesive mixture from the discharge end of hose 13 onto the fiber before application. Because the fiber is not coated with silicone, fiber bonding in cavity 5 is improved. In such a manner, the inorganic loose-fill from hose 11 is coated with the liquid (e.g. water-based adhesive) from hose 13 and thereafter blown into vertically extending open cavity 5 as shown in FIG. 1.

Figure 2:
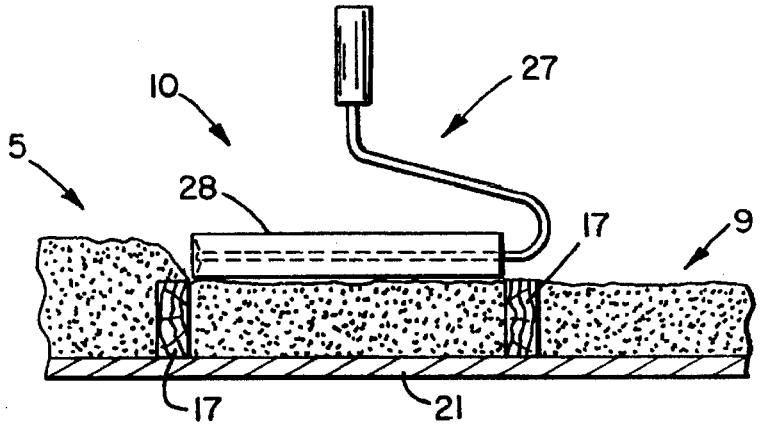
FIG. 2 is a top cross-sectional view of the vertical wall structure of FIG. 1, this view illustrating cross-sectionally the studs and supporting wall and elevationally a roller for compression rolling the sprayed-on insulation into the open cavities in accordance with this invention.

Following blowing and filling of cavity 5 so that the sprayed-on insulation protrudes outwardly from the cavity about one inch, non-stick roller 27 with freely rotating roll 28 is used to pack the insulation fully into the cavity as shown in FIG. 2. The user manipulates roller 27 up and down over the sprayed-on insulation between the vertical studs and in doing so packs the protruding insulation into the confines of the cavity so that drywall can be attached in a known manner. It has been found by the instant inventors that gaps or voids in the sprayed-on insulation predominantly expose themselves (i.e. become apparent) only after rolling. Thus, the user determines or observes after this rolling step whether the cavity is filled or if additional loose-fill needs to be inserted into the cavity to fill visible voids and/or gaps.

This invention will now be described with respect to certain examples as follows.

EXAMPLES 1–12

The following preparation, application, and post-application steps and/or descriptions were common to spray-on Examples 1–12 herein. The processes began with the user mixing adhesive (i.e. binding agent) at a ratio of about eight parts tepid water to one part (8:1) vinyl acetate homopolymer/polyvinyl alcohol blend adhesive (although ratios as small as 16:1 or 32:1 may be used in certain embodiments). The approximate 45% resin solids (adhesive concentrate) mixed with water yielded about a 5% solids solution ready for application at the 8:1 ratio. Next, the user added a polymer cross-linking catalyst (identified below) to this mixture at a ratio of about 25% of the amount of adhesive concentrate used. The catalyst was added to the adhesive/water mixture within the twenty-four hour period prior to use.

A commercially available pneumatic blowing machine was used to apply the fiberglass, the machine being initially set to run at about 1950–1980 RPM. Adhesive pump 25 was set to supply approximately 0.32 gallons per minute of the liquid adhesive product through the jets (not shown) on the spray head at a pressure not less than about 100 PSI. Insulation loose-fill blower 23 was adjusted to blow a 30 lb. bag Of white loose-fill diced Guardian Fiberglass (substantially free of silicone) in approximately 3½ to 4 minutes. The virgin white loose-fill had a total LOI of about 0.20% before being introduced into blower 23. Blower 23 required some air bleed off. The jets (not shown) at nozzle area 15 were installed into the spray head at the 12 o'clock and 6 o'clock positions as known in the trade with a "flat" spray trajectory being set in the horizontal position of each jet.

User 3 stood on the ground approximately 5 to 6 feet from wall structure 7. User 3 then turned on the adhesive valve to ensure proper spray pattern and lightly pre-coated rear wall 32 of vertically extending open cavity 5 with the water-based adhesive. Rear wall 32 was made of plywood. The user then turned off the adhesive mixture at the nozzle on hose 13.

After adhesive pre-coating, the user turned on blower 23 and then immediately again turned on the adhesive flow valve. The loose-fill virgin white fiberglass being discharged from the nozzle end of hose 11 was coated with the liquid adhesive (including the catalyst) from hose 13 and thereafter sprayed or blown into cavity 5 where it stuck as shown in FIG. 1. User 3 manipulated the spray nozzle in a side-to-side or back and forth manner building shelf upon shelf 16 of insulation starting at the bottom of cavity 5 near the lower horizontal stud 19 and proceeded upward as the cavity was filled. In other words, user 3 manipulated nozzle area 15 back and forth between the cavity defining studs 17 so that the insulation was built on top of itself upwardly from the bottom of cavity 5 toward the top as shown in FIG. 1. All studs were 2"×4" and of wood. Cavity 5 was filled to a thickness of about 1 inch beyond (or exterior) the most outward protrusion of vertical studs 17 (i.e. the insulation was about 4.5 to 5.0 inches thick as originally applied). Fiber velocity out of hose 11 was kept relatively low to ensure density control which resulted in good adhesion or sticking within cavity 5.

Immediately after fiberglass spraying into cavity 5, the installed fiberglass product was compression rolled using non-stick roller 27 (see FIG. 2) to pack the insulation within the cavity to a thickness of about 3.5 inches substantially flush with the exterior faces of studs 17. There was some resiliency in the fiber at this point, but the rolling compressed the sprayed-on fiberglass to a point which greatly facilitated the possible application of drywall. After rolling, if and when gaps or voids in the insulation finally became observed or evident, residual or overspray fiberglass which had fallen to the floor was placed and packed in the cavity to fill such voids.

The front faces of studs 17 and 19 were then cleaned of fiber overspray with a stud scraper/cleaner (not shown), this process providing clean stud faces to which conventional drywall could be nailed or screwed. Residual, overspray, or fallout fiber was packed within the cavity or re-introduced (this is optional) into loose-fill blower 23 at the hopper, at a controlled rate, for respraying. Clean-up was accomplished by purging the entire liquid adhesive application system with clean and clear water. The user then allowed the coated sprayed-on fiberglass to cure. Curing (i.e. drying) at this 3½" thickness took about twenty-four hours after which the applied LOI data/measurements were taken.

The procedure and steps set forth above were carried out numerous times (the temperature was ambient atmosphere) resulting in the twelve exemplary results set forth below in Chart 1.

CHART 1

| Example No. | Density (lb./ft$^3$) | R-Value at 3.5" Insulation Thickness | Applied LOI % | Moisture % upon application |
|---|---|---|---|---|
| 1 | 1.69 | 12.20 | — | — |
| 2 | 1.62 | 12.96 | — | — |
| 3 | 1.67 | 12.50 | 1.36% | 13.284% |
| 4 | 1.73 | 12.20 | 1.81% | 7.043% |
| 5 | 1.98 | 12.80 | — | — |
| 6 | 2.02 | 13.50 | 0.73% | 9.272% |
| 7 | 2.10 | 12.10 | 0.84% | — |
| 8 | 2.20 | 13.10 | — | — |
| 9 | 2.20 | 12.40 | 1.14% | — |
| 10 | 2.28 | 13.20 | — | — |
| 11 | 2.30 | 12.50 | 0.85% | 10.163% |
| 12 | 2.01 | 13.80 | — | — |

Example Nos. 1–5, 7, 9, 11, and 12 utilized ammonium dihydrogen phosphate as the polymer cross-linking catalyst, while Example Nos. 6, 8, and 10 (and 13–15) used ammonium chloride as the cross-linking catalyst, while the adhesive blend had a higher viscosity in Example Nos. 6, 8, and 10 than in the others listed in Chart 1. The listed moisture % data was measured immediately after the coated fiberglass was sprayed into cavity 5, and is indicative of the total moisture weight relative to the total sprayed-on product weight in the cavity. The moisture % by weight of the product immediately after spraying is less than or equal to about 35% according to certain embodiments, more preferably less than about 15%. As in all Examples herein, the applied LOI % (loss-on-ignition) data was measured after curing and indicates the adhesive amount used via hose 13 in spraying (i.e. the amount of adhesive used to coat the fiberglass at nozzle area 15). As in all Examples herein the density data was taken after curing.

The term "LOI" as used herein is defined by ASTM C764-91 which is incorporated herein by reference. Losson Ignition (LOI) refers to this known method for measuring the binder content of loose-fill mineral fiber insulation.

EXAMPLES 13–15

Examples 13–15 were performed in a manner similar to that described above with respect to Examples 1–12 except that diced up yellow fiberglass loose-fill was used instead of the virgin white loose-fill described above. The yellow loose-fill fiberglass originated from commercially available Guardian batts (including binder) having a standard cube size, this yellow diced up batt insulation having a total LOI of about 5.50% before being introduced into blower 23. Additionally, more adhesive via hose 13 was used in Examples 13–15 than in the previous Examples as is set forth below in the Applied LOI data. Chart 2 sets forth the data taken in Examples 13–15.

CHART 2

| Ex. No. | Density (lb/ft$^3$) | R-Value at 3.5" Thickness | Applied LOI % | Total LOI % After Curing |
|---|---|---|---|---|
| 13 | 1.60 | 12.8 | 4.34% | 9.84% |
| 14 | 1.63 | 12.6 | 3.07% | 8.57% |
| 15 | 1.72 | 13.2 | 3.76% | 9.26% |

The catalyst and adhesive in Examples 13–15 were the same as in Examples 6, 8, and 10. The Applied LOI % as always herein was determined by taking the total LOI % (after curing for at least about 24 hours) and substracting from it the pre-blowing LOI %. Thus, for Example 13, the Applied LOI % was found to be 9.84%–5.50% =4.34%. The yellow (binder inclusive) fiberglass used in Examples 13–15 required additional liquid adhesive via hose 13 in order to make it stick inside of the vertically extending open cavity 5 (relative to Examples 1–12) as indicated by the fact that the Applied LOI % for Examples 13–15 was higher than for Examples 12. However, lower densities were achieved with the binder inclusive yellow (as opposed to virgin white) fiberglass used in Examples 13–15.

EXAMPLES 16–18

Examples 16–18 were similar to Nos. 1–12 described above except that (i) four jets (H1/SVV 1501 at 100 PSI) were used in the application system; (ii) the loose-fill white fiberglass was mixed with a dry redispersible powder adhesive (RP-238 available from Air Products, Lehigh Valley, Pa.) before blowing through hose 11; (iii) hose 13 and pump 25 caused only water to be mixed with the dry fiberglass/adhesive mixture at nozzle area 15 so as to activate the RP-238 adhesive; and (iv) the total weight of the dry RP-238 powder water-activatable adhesive relative to the loose-fill it was mixed with was about 1.1%. The measured results of Example Nos. 16–18 are set forth below in Chart No. 3.

CHART 3

| Example No. | Density (lb/ft$^3$) | R-Value at 3.5" thickness | Applied LOI % |
|---|---|---|---|
| 16 | 2.50 | 13.4 | 1.38% |
| 17 | 2.27 | 11.9 | 1.36% |
| 18 | 2.00 | 13.0 | 1.36% |

EXAMPLE 19

Example 19 was similar to Example Nos. 1–12 where Resin No. 51-5626 (United Resins) was used to coat the white loose-fill except that the adhesive was mixed at about a 32:1 ratio (instead of 8:1) and four jets were used. This Example resulted in a density (lb./ft$^3$) of 2.15, an R-value of 12.3 (3.5" thick) and an applied LOI of 0.96%.

EXAMPLES 20–25

Examples 20–25 were similar to Examples 1–15 except that four jets were used and no adhesive was used (i.e. the virgin loose-fill was coated only with water at nozzle area 15 and thereafter blown into cavity 5). The results are set forth below in Chart 4.

CHART 4

| Example No. | Density (lb/ft$^3$) | R-Value at 3.5" thickness |
|---|---|---|
| 20 (W) | 2.24 | 13.7 |
| 21 (W) | 2.39 | 13.4 |
| 22 (Y) | 2.00 | 13.2 |
| 23 (Y) | 2.14 | 13.4 |
| 24 (Y) | 2.43 | 14.3 |
| 25 (Y) | 2.15 | 13.3 |

Example Nos. 20–21, referred to as "(W)" used loose-fill white fiberglass coated with silicone while Nos. 22–25 (Y) used diced loose-fill binder inclusive yellow fiberglass (uncoated with silicone). Nos. 20–21 are the only Examples herein which used silicone-coated loose-fill.

In sum, the Examples set forth above show the improved results provided by certain embodiments of this invention in that a low density/high R-value inorganic fiberglass product is achieved in a spray-on system using as little adhesive as possible. The density is less than or equal to about 2.5 lb./ft$^3$, more preferably less than or equal to about 2.0 lb./ft$^3$, and most preferably less than or equal to about 1.75 lb./ft$^3$. At the same time, R-values for a 3.5 inch rolled thickness of at least about 11.0 are achieved, more preferably at least about 12.0, and most preferably at least about 13. This translates into R-values of at least about 3.15 per inch thickness, 3.43 per inch thickness, and 3.71 per inch thickness respectively. With respect to the applied LOI %, Examples 1–12 and 16–19 all had an applied LOI % less than 2.0%, and, in fact, less than about 1.81% when the virgin white loose-fill (free of binder) was used. Examples 13–15 all had an applied LOI % less than about 5.0%, and, in fact, less than about 4.34%. While it is always possible to use more adhesive, this increases the cost of the product. Thus, it is preferable to keep the applied LOI % to less than about 10%, more preferably less than about 5.0%, and most preferably less than about 2.0% according to certain embodiments of this invention.

Once given the above disclosure many other features, modifications, and improvements will become apparent to the skilled artisan. Such other features, modifications, and improvements are therefore considered to be a part of this invention, the scope of which is to be determined by the following claims.

We claim:

1. A method of spraying loose-fill fiberglass insulation substantially free of silicone together with a non-foaming liquid into a vertically extending open wall cavity for the purpose of filling the open wall cavity with insulation, the method comprising the steps of:

coating the loose-fill fiberglass substantially free of silicone with the non-foaming liquid;

blowing the loose-fill fiberglass insulation coated with the non-foaming liquid, together with an adhesive, into the vertically extending open wall cavity in order to insulate the vertically extending open wall cavity, so that the coated fiberglass insulation and adhesive are retained in the open wall cavity without a need for a provision of an enclosing structure during said blowing, and the blown insulation in the open wall cavity has a moisture percentage by weight less than about 35% immediately after blowing to reduce cure time; and allowing the fiberglass insulation and adhesive in the open wall cavity to cure so that when the installed and cured fiberglass insulation is about 3.5 inches thick in the wall cavity, it has an R-value of at least about 13.0, a density of less than or equal to about 2.5 lbs-/ft$^3$, an applied loss-on-ignition percentage of less than about 2.0% to reduce cure time.

2. The method of claim 1, wherein said curing step results in the installed and cured fiberglass insulation when about 3.5 inches thick having an R-value greater than about 12.0 and a density less than about 2.0 lb./ft$^3$.

3. The method of claim 2, wherein said allowing to cure step results in the installed and cured fiberglass insulation having a density less than or equal to about 1.75 lb./ft$^3$.

4. The method of claim 1, wherein said non-foaming liquid includes a liquid adhesive, and a catalyst.

5. The method of claim 4, wherein the catalyst is a polymer cross-linking catalyst.

6. The method of claim 5, wherein the adhesive is a water-based vinyl acetate homopolymer/polyvinyl alcohol blend.

7. The method of claim 6, wherein the catalyst includes one of ammonium chloride and ammonium dihydrogen phosphate.

8. The method of claim 1, further comprising the step of providing the loose-fill fiberglass substantially free of silicone so as to attain improved coating of the fiberglass with the liquid and improved adhesion or fiber bonding in the cavity.

9. The method of claim 1, further comprising the step of rolling the coated fiberglass after it has been blown into the cavity so as to pack or compress the coated insulation into the open cavity, said rolling step being performed before said curing step.

10. The method of claim 9, further comprising the step of:

blowing the coated fiberglass insulation into the open and vertically extending cavity from the bottom upward so as to repeatedly build the blown and coated fiberglass on top of itself so as to fill the open cavity from the bottom up.

11. The method of claim 1, wherein the blown loose-fill fiberglass is substantially binder-free and has a fiber diameter of from about 3.5 to 5.0 microns, and wherein said curing step results in the installed and cured fiberglass insulation having an applied LOI (loss-on-ignition) of less than about 2.0%.

* * * * *